US005174837A

United States Patent [19]

Boileau et al.

[11] Patent Number: 5,174,837

[45] Date of Patent: Dec. 29, 1992

[54] TEMPERATURE-RESISTANT, FRAGMENTABLE PROPELLENT CHARGES

[75] Inventors: Jacques Boileau, Paris; Louis Leneveu, Chateaulin, both of France

[73] Assignee: Societe Nationale des Poudres et Explosifs, Paris Cedex, France

[21] Appl. No.: 788,531

[22] Filed: Nov. 6, 1991

Related U.S. Application Data

[62] Division of Ser. No. 653,005, Feb. 8, 1991.

[30] Foreign Application Priority Data

Feb. 21, 1990 [FR] France ..... 90 02092

[51] Int. Cl.[5] ..... C06B 45/10

[52] U.S. Cl. ..... 149/19.91; 149/12; 149/19.8; 149/96; 102/283

[58] Field of Search ..... 149/12, 19.91, 19.8, 149/96; 102/283

[56] References Cited

U.S. PATENT DOCUMENTS

| | | | |
|---|---|---|---|
| 3,154,448 | 10/1964 | Tsou et al. | 149/19.91 |
| 3,679,781 | 7/1972 | Olson et al. | 149/12 |
| 4,023,996 | 5/1977 | Leneveu | 149/19.91 |
| 4,279,672 | 7/1981 | Leneveu et al. | 149/19.8 |
| 4,326,901 | 4/1982 | Leneveu et al. | 179/12 |
| 4,347,087 | 8/1982 | Zeller et al. | 149/19.8 |
| 4,365,558 | 12/1982 | Lippler et al. | 149/12 |

*Primary Examiner*—Edward A. Miller
*Attorney, Agent, or Firm*—Bucknam and Archer

[57] ABSTRACT

The present invention relates to the field of propellent charges for small and medium calibre arms.

The invention relates to a process for the manufacture of fragmentable propellent charges, which consists in a first stage in coating powder particles with a mixture of dinitropolystyrene and of a compound of the polyvinyl nitrate and/or polyvinyl acetate type and, in a second stage, in compressing at between 100° C. and 140° C. the powder particles thus obtained.

The invention also relates to the fragmentable charges obtained by the process and to the coated particulate powders obtained at the end of the first stage of the process.

The fragmentable charges according to the invention exhibit a temperature behaviour which is superior to that of traditional fragmentable charges and are suitable for cartridgeless ammunition intended for arms with a high rate of fire.

7 Claims, No Drawings

TEMPERATURE-RESISTANT, FRAGMENTABLE PROPELLENT CHARGES

This is a divisional of application Ser. No. 653,005, filed Feb. 8, 1991.

The present invention relates to the field of propellent charges for arms with a barrel of small and medium calibre. More precisely, the invention relates to a process for the manufacture of temperature-resistant, fragmentable propellent charges and to the powders and charges obtained by this process.

In order to have available maximum propellent energy in ammunition for arms with a barrel of small and medium calibre, attempts are made to increase the density of the charge by agglomerating it. When burning, such an agglomerated charge must fragment, owing to the effect of the pressure rise, to reform the constituent particles of the initial powder and to burn like a loose-bulk charge. Agglomerated charges are found to be particularly advantageous in the case where, still to have maximum energy available, attempts are also made to dispense with the cartridge case to obtain so-called "telescoped" ammunition as described, for example, in French Patent 2,357,854.

A fragmentable charge is obtained basically by compressing particles of propellent powder.

This compression is generally carried out on powder particles impregnated with a plasticiser for nitrocellulose or with a crosslinkable binder, as described, for example, in U.S. Pat. No. 3,655,836 or FR 2,374,278.

Nevertheless, where industrial feasibility is concerned, it is preferred to avoid liquid plasticisers or binders and, moreover, in order to increase the charge energy, attempts are made to employ energetic binders. This twin requirement has led those skilled in the art to turn towards heated compression of the powder particles in the presence of an energetic thermoplastic binder. An energetic thermoplastic binder which is particularly advantageous is found to be polyvinyl nitrate. Two possible ways of employing this binder exist, with a view to the manufacture of fragmentable agglomerated propellent charges. A first possibility, described, for example, in French Patent 2,411,817, consists in performing, with heating, the compression of a mixture of powder particles and of particles of a binding composition based on polyvinyl nitrate. A second possibility, described, for example, in French Patent 2,436,766, consists in performing, with heating, the compression of powder particles coated with a film based on polyvinyl nitrate.

Coating of the powder particles is carried out by means of a coating operation during which a solution of polyvinyl nitrate in a volatile solvent is sprayed onto the powder particles.

The fragmentable charges obtained from propellent powder which is compressed in the presence of polyvinyl nitrate are, in fact, energetic and fragment very well at the time of firing, but exhibit a use limitation linked with the poor temperature behavior of the polyvinyl nitrate, which softens at 70° C. and above. Now, many types of current ammunition have use specifications which require good mechanical behavior up to at least 100° C.

At the present time there is therefore a real need for fragmentable propellent charges which exhibit the same ballistic properties as the known charges obtained from particulate propellent powder and polyvinyl nitrate, but which are more resistant to temperature.

The aim of the invention is precisely to offer such fragmentable propellent charges and a process for the manufacture of these charges.

The invention relates, therefore, to a process for the manufacture of fragmentable propellent charges for cartridgeless ammunition from particulate propellent powder, characterised in that in a first stage the said powder particles are firstly subjected to a coating operation in the course of which the powder particles are sprayed with a mixture containing at least one dinitropolystyrene, a stabiliser and a polyvinyl alcohol derivative chosen from the group consisting of polyvinyl nitrate and polyvinyl acetate, the said mixture being in solution in a solvent medium, and in that, after evaporation of the said solvent medium, in a second stage the powder particles thus obtained are compressed at a temperature of between 100° C. and 140° C.

According to a preferred embodiment of the invention the weight ratio of dinitropolystyrene to the combination of dinitropolystyrene and polyvinyl alcohol derivative is between 25% and 75%.

According to a first alternative form, a proportion of the polyvinyl alcohol derivative is replaced by cellulose acetate.

According to a second alternative form, the said solvent medium comprises at least one solvent for dinitropolystyrene, chosen from the group consisting of cyclohexanone, tetraalkylureas like tetramethylurea, nitrobenzene, butyrolactone and tetramethylene sulphone.

The invention also relates to the fragmentable propellent charges for cartridgeless ammunition which are obtained by the process according to the invention.

The invention relates in particular to the charges in which the particulate propellent powder is a powder with a single nitrocellulose base.

Lastly, the invention also relates to the propellent powder particles obtained at the end of the first stage of the process according to the invention, which are characterised in that the said particles are coated with a film of a mixture containing at least one dinitropolystyrene, a stabiliser and a polyvinyl alcohol derivative chosen from the group consisting of polyvinyl nitrate and polyvinyl acetate.

A detailed description of the invention is given below.

The process according to the invention consists, therefore, in a first stage, in coating propellent powder particles with a film of an energetic thermoplastic material and, in a second stage, in compressing, with heating, the powder particles coated in this way.

Most of the propellent powders known to those skilled in the art may be employed as propellent powder within the scope of the present invention. Thus, in particular, it is possible to employ powders with a single nitrocellulose base or so-called "composite" powders consisting chiefly of a nitramine like hexogen or octogen and of an organic binder such as a polyurethane, a polyester, a cellulose acetobutyrate by itself or mixed with nitrocellulose, and triethyl citrate acetate.

Within the scope of the present invention it is also possible to employ powders containing nitroglycerine or more generally a nitrated oil, like so-called "double base" powders consisting of a mixture of nitrocellulose and nitroglycerine or so-called "multibase" powders consisting of nitrocellulose, nitroglycerine and of one or more nitrated energetic compounds such as nitroguanidine, hexogen, octogen, pentrite, dinitroglycolurile, and the like.

However, in the case of these powders, the Applicant Company advises against the use of powders containing a high proportion of nitroglycerine, to avoid the risk of migration of nitroglycerine with time into the film coating of the powder particles, a phenomenon which gives rise to a risk of perturbing the fragmentation of the charge at the time of firing. In practice, the Applicant Company recommends that powders whose nitroglycerine or nitrated oil content is higher than 25% by weight should not be employed.

In the case of the majority of the charges intended for small and medium calibre arms, powders with a simple nitrocellulose base will usually be employed.

The geometry of the powder particle will depend on the intended dimensions and properties of the fragmentable charge.

The powder particles, polished or unpolished, are therefore coated with a film of an energetic thermoplastic material. According to the invention this material characteristically consists of the mixture of at least one dinitropolystyrene, a stabiliser and a polyvinyl alcohol derivative chosen from the group consisting of polyvinyl nitrate and polyvinyl acetate. According to the invention the weight ratio of dinitropolystyrene to the combination consisting of dinitropolystyrene and the polyvinyl alcohol derivative(s) must be between 25% and 75%.

Dinitropolystyrene is an organic polymer of formula

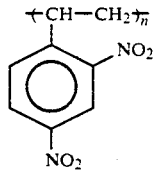

in which the symbols C, H, O and N denote carbon, hydrogen, oxygen and nitrogen respectively and n denotes an integer.

Dinitropolystyrenes of various molecular masses may be employed within the scope of the present invention, but preference will be given to those whose softening temperature is higher than 260° C. This condition is met with dinitropolystyrenes whose molecular mass is close to 500,000, which corresponds to a degree of polymerisation n close to 2,000.

Dinitropolystyrene is advantageously obtained by nitrating polystyrene according to techniques described, for example, in the following works: Memorial des Poudres, volume 35, 1953, pages 41 to 50 (Boileau, Pujo, Lang), Encyclopedia of Explosives and Relative Items, volume 8, 1978, pages 143-144, or in U.S. Pat. No. 3,715,323.

Traditional stabilisers for nitrated compounds, like diphenylamine or 2-nitrodiphenylamine, may be employed as a stabiliser for the mixture; nevertheless, the preferred stabiliser in 2-nitrodiphenylamine. This stabiliser will be present in the mixture in a proportion of approximately 2% by weight of the total weight of the combination of dinitropolystyrene and polyvinyl alcohol derivatives.

The mixture coating the powder particles therefore contains at least one polyvinyl alcohol derivative chosen from the group consisting of polyvinyl nitrate and polyvinyl acetate. It may contain these two derivatives simultaneously. According to an alternative embodiment of the invention a proportion of the polyvinyl alcohol derivatives may be replaced by cellulose acetate, but, and this involves an important condition of use of the invention, cellulose acetate cannot completely replace the polyvinyl alcohol derivatives. The polyvinyl alcohol derivatives, polyvinyl nitrate and/or polyvinyl acetate, must replace at least one third by weight of the total weight of the combination of cellulose acetate+polyvinyl alcohol derivatives.

In the event of partial replacement of the polyvinyl alcohol derivatives by cellulose acetate, the general condition relating to the weight composition of the coating mixture remains, and is generalised as follows:

$$25\% \leqq \frac{[DNPS]}{[DNPS] + [PVN] + [PVAc] + [CELLAc]} \leqq 75\%$$

[DMPS] = weight of dinitropolystyrene

[PVN] = weight of polyvinyl nitrate

[PVAc] = weight of polyvinyl acetate

[CELLAc] = weight of cellulose acetate, where it must be remembered that:

$$\frac{[PVN] + [PVAc]}{[PVN] + [PVAc] + [CELLAc]} \geqq 1/3$$

The actual coating of the powder particles takes place in the course of a coating operation during which the powder particles are sprayed with the coating mixture dissolved in a solvent medium.

The solvent medium comprises at least one solvent for dinitropolystyrene, chosen from the group consisting of cyclohexanone, tetramethylurea, nitrobenzene, butyrolactone and tetramethylene sulphone, also known under the trademark Sulfolane®, so as to ensure good dissolution of dinitropolystyrene. The preferred solvents for dinitropolystyrene within the scope of the invention are cyclohexanone, tetramethylurea and tetramethylene sulphone.

According to an alternative embodiment of the invention, the said solvent is employed as a mixture with an auxiliary solvent which is a good solvent for polyvinyl alcohol derivatives and for cellulose acetate. Acetone is a preferred auxiliary solvent within the scope of the present invention. This solution offers the additional advantage of not lowering the potential of the powder excessively owing to the coating operation.

The quantity of coating material deposited on the powder particles must represent approximately two per cent of the weight of the powder. This deposit is produced by spraying the solution of coating material onto the powder particles, for example in a rotary pellet mill, as for a conventional polishing operation. After spraying the solution, removal of the solvent medium is ensured by drying in air, optionally supplemented by oven-drying at atmospheric pressure or under vacuum.

Thus coated, the powder particles are then compressed to the shape and to the dimensions of the desired fragmentable charge. This compression is advantageously performed at a temperature of between 100° C. and 140° C. A pressure in the region of 100 bars, that is $10^7$ Pa, is generally sufficient for the usual charges intended for small and medium calibre arms.

This second stage of the process may follow either immediately after the first stage or subsequently in time, as is explained later in the description.

The invention also relates to the fragmentable propellent charges thus obtained.

A "charge" within the meaning of the present application means either the propellent charge as a whole, if it consists of a single member, or a constituent member of the charge if the latter consists of a plurality of members.

These charges obtained by agglomerating coated powder particles according to the invention exhibit good mechanical behavior when cold and still retain some mechanical strength at 100° C., in contrast to the charges obtained by agglomeration of powder particles which are coated only with polyvinyl nitrate. Moreover, the charges according to the invention exhibit ballistic properties which are comparable with those of conventional charges and, especially, exhibit a completely correct fragmentation on burning.

They find an advantageous application in cartridgeless ammunition, especially for arms with a high rate of fire.

In the case of small or medium calibre arms with a high rate of fire, use will be advantageously made of the propellent charges according to the invention which are obtained from propellent powder with a single nitrocellulose base, this powder being today the most widely used and the most economical.

Finally, the invention also relates to the constituent powders of the charges according to the invention. More precisely the invention relates to the propellent powder particles obtained at the end of the first stage of the process according to the invention after evaporation of the solvent medium. These powder particles are coated with a film of a mixture containing at least one dinitropolystyrene, a stabiliser and a polyvinyl alcohol derivative chosen from the group consisting of polyvinyl nitrate and polyvinyl acetate. The invention relates particularly to the coated particles obtained from a powder with a single nitrocellulose base. Such powder particles keep well with time and can be easily transported. They thus make it possible to separate, in time and even in space, the two stages of the process according to the invention, depending on requirements.

The examples which follow illustrate some potential uses of the invention without limiting its scope.

EXAMPLE 1—REFERENCE EXAMPLE

For this reference example a fragmentable charge was manufactured from particulate propellent powder coated with polyvinyl nitrate alone according to the technique described in French Patent 2,436,766.

The powder employed is a conventional powder with a single nitrocellulose base in the form of cylindrical particles comprising a central hole, with a 0.25-mm web (burning thickness). Initially, the powder is unpolished and ungraphited and its potential energy is 4,034 joules/g, that is 965 cal/g.

Powder coating is carried out as follows: 5 kg of powder and 2.5 g of graphite are introduced into a pellet mill heated to 25° C., and are sprayed three times with a coating solution whose overall composition is as follows:

polyvinyl nitrate: 2% of the weight of powder
acetone: 20% of the weight of powder
ethanol: 4% of the weight of powder
2-nitrodiphenylamine:0.04% of the weight of powder The temperature of the coating solution is 60° C., the pellet mill temperature being 25° C.

After spraying, the pellet mill is left to rotate for 5 minutes with the doors open. The coated powder is then introduced into a mould heated to 110° C., the powder is left in the mould for 5 minutes and is compressed for one minute at $10^7$ Pa, that is 100 bars. Solid cylindrical fragmentable blocks are thus obtained, with a height of 22 mm and a diameter of 12.6 mm, exhibiting the following characteristics:

Potential energy: 3,840 joules/g that is 918 cal/g
Appearance: correct
Crushing strength:
+21° C.: 0.60 kN/cm$^2$
+100° C.: mechanical strength too low to be capable of being measured.

EXAMPLES 2 TO 6

Fragmentable charges according to the invention were manufactured from particulate propellent powder coated with a mixture of polyvinyl nitrate (PVN) and dinitropolystyrene (DNPS) in the presence of 2-nitrodiphenylamine (2-NDPA) as stabiliser.

The powder employed was the same as that in Example 1 and the procedure used for the coating was as described in Example 1, with coating solutions whose overall compositions were as follows:

| | EX 2 | EX 3 | EX 4 | EX 5 | EX 6 |
|---|---|---|---|---|---|
| PVN | 1% | 0.5% | 1% | 1.2% | 1.5% |
| DNPS | 1% | 1.5% | 1% | 0.8% | 0.5% |
| Cyclohexanone | 18% | 18% | 7% | 5.6% | 4% |
| Acetone | 0% | 0% | 15% | 18% | 18% |
| 2-NDPA | 0.04% | 0.04% | 0.04% | 0.04% | 0.04% |

The percentages are expressed as weight relative to the total weight of the powder.

The dinitropolystyrene employed had a nitrogen content of 14.81%, an average molecular mass of 500,000 and a softening point higher than 260° C. This dinitropolystyrene was employed in all the examples.

Compression of the coated particles was performed in a manner similar to that described in Example 1, the compression temperature being 130° C.

Blocks which were similar to those of Example 1 were obtained, exhibiting the following characteristics:

| | EX 2 | EX 3 | EX 4 | EX 5 | EX 6 |
|---|---|---|---|---|---|
| Potential energy (joules/g) | 3,400 | 3,436 | 3,920 | 3,915 | 3,929 |
| Potential energy (cal/g) | 815 | 822 | 938 | 937 | 940 |
| Cyclohexanone | 4% | 3.7% | 0.9% | 0.5% | 0.35% |
| Block appearance | correct | correct | correct | correct | correct |
| Crushing strength at 21° C. in kN/cm$^2$ | 0.50 | 0.55 | 0.90 | 0.56 | 0.60 |
| Crushing strength at 100° C. in kN/cm$^2$ | 0.40 | 0.55 | 0.70 | 0.53 | 0.20 |

The residual percentage of cyclohexanone is expressed as weight relative to the total weight of the charge.

It is found that all the charges according to the invention still have some degree of crushing strength at +100° C., whereas the reference charge (Example 1) no longer has any mechanical strength at this temperature.

Moreover, with a view to maintaining high potential energies, it is advantageous to employ cyclohexanone mixed with acetone (Examples 4, 5 and 6), rather than by itself (Examples 2 and 3).

Finally, all the firings in a pressure bomb at the time when the potential energies were determined showed very good fragmentation of the charges according to the invention.

EXAMPLE 7

A fragmentable charge according to the invention was manufactured from particulate propellent powder coated with a mixture of polyvinyl acetate (PVAc) and dinitropolystyrene (DNPS) in the presence of 2-nitrodiphenylamine (2-NDPA) as stabiliser.

The powder employed is the same as that of Example 1. Coating is carried out as follows: 5 kg of powder and 2.5 g of graphite are introduced into a pellet mill heated to 25° C. and are sprayed four times with a coating solution whose overall composition is as follows:

PVAc: 1% of the weight of powder
DNPS: 1% of the weight of powder
cyclohexanone: 10% of the weight of powder
acetone: 10% of the weight of powder
2-NDPA: 0.04% of the weight of powder The temperature of the coating solution was 60° C. After spraying, the pellet mill was left rotating for 5 minutes with the doors open and the powder was then dried in an oven at 60° C. for 16 hours.

The coated powder was then introduced into a mould heated to 130° C., the powder was left in the mould for 5 minutes and was compressed for 1 minute at $10^7$ Pa, that is 100 bars.

Solid cylindrical fragmentable blocks were thus obtained, with a height of 22 mm and a diameter of 12.6 mm, exhibiting the following characteristics:

Appearance: correct
Potential energy: 3,770 joules/g that is 902 cal/g
Crushing strength:
+21° C.: 1.01 kN/cm$^2$
+100° C.: 0.86 kN/cm$^2$

EXAMPLE 8

A fragmentable charge according to the invention was manufactured from particulate propellent powder coated with a mixture of dinitropolystyrene (DNPS), polyvinyl nitrate (PVN) and polyvinyl acetate (PVAc) in the presence of 2-nitrodiphenylamine (2-NDPA) as stabiliser.

A procedure as described in Example 7 was carried out with a coating solution whose overall composition was as follows:

DNPS: 0.67% of the weight of powder
PVN 0.67% of the weight of powder
PVAc: 0.67% of the weight of powder
b 2-NDPA: 0.04% of the weight of powder
cyclohexanone: 10% of the weight of powder
acetone: 10% of the weight of powder Fragmentable blocks were thus obtained, exhibiting the following characteristics:

Appearance: correct
Potential energy: 3,860 joules/g that is 924 cal/g
Crushing strength:
+21° C.: 0.66 kN/cm$^2$
+100° C.: 0.44 kN/cm$^2$ Examples 7 and 8 show that polyvinyl acetate can replace polyvinyl nitrate in all proportions within the scope of the present invention.

EXAMPLE 9

A fragmentable charge according to the invention was manufactured from particulate propellent powder coated with a mixture of dinitropolystyrene (DNPS), polyvinyl nitrate (PVN) and cellulose acetate in the presence of 2-nitrodiphenylamine (2-NDPA) as stabiliser.

A procedure as described in Example 7 was carried out with a coating solution whose overall composition was as follows:

DNPS: 0.67% of the weight of powder
PVN: 0.67% of the weight of powder
CELLAc: 0.67% of the weight of powder
cyclohexanone: 10% of the weight of powder
acetone: 10% of the weight of powder
2-NDPA: 0.04% of the weight of powder Fragmentable blocks were thus obtained, exhibiting the following characteristics:

Appearance: correct
Potential energy: 3,854 joules/g that is 922 cal/g
Crushing strength:
+21° C.: 0.24 kN/cm$^2$
+100 C: 0.23 kN/cm$^2$

EXAMPLE 10

Attempts were made to manufacture a fragmentable charge from particulate propellent powder coated with a mixture of dinitropolystyrene (DNPS) and cellulose acetate (CELLAc) in the presence of 2-nitrodiphenylamine (2-NDPA) as stabiliser.

The procedure was as described in Example 7 with a coating solution whose overall composition was as follows:

DNPS: 1% of the weight of powder
CELLAc: 1% of the weight of powder
2-NDPA: 0.04% of the weight of powder
cyclohexanone: 10% of the weight of powder
acetone: 10% of the weight of powder While coating of the polymer presents no problem, it is found impossible, on the other hand, to obtain by compression a self-supporting block from the powder particles coated in this way.

Comparison of Examples 9 and 10 shows that while cellulose acetate can partially replace the polyvinyl alcohol derivatives, it cannot replace them completely within the scope of the present invention.

EXAMPLE 11

A fragmentable charge according to the invention was manufactured from particulate propellent powder coated with a mixture of dinitropolystyrene (DNPS) and polyvinyl nitrate (PVN) in the presence of 2-nitrodiphenylamine (2-NDPA) as stabiliser and using nitrobenzene as solvent.

A procedure as described in Example 7 was carried out with a coating solution whose overall composition was as follows:

DNPS: 1% of the weight of powder
PVN: 1% of the weight of powder
2-NDPA: 0.04% of the weight of powder
nitrobenzene: 15% of the weight of powder Fragmentable blocks were thus obtained, exhibiting the following characteristics:

Appearance: correct
Potential energy: 3,460 joules/g that is 828 cal/g
Crushing strength:
+21° C.: 0.49 kN/cm$^2$
+100° C.: 0.23 kN/cm$^2$

EXAMPLE 12

A fragmentable charge according to the invention was manufactured from particulate propellent powder coated with a mixture of dinitropolystyrene (DNPS) and polyvinyl-nitrate (PVN) in the presence of 2-nitrodiphenylamine (2-NDPA) as stabiliser and using tetramethylurea as solvent.

A procedure as described in Example 7 was carried out with a coating solution whose overall composition was as follows:

DNPS: 1% of the weight of powder
PVN: 1% of the weight of powder
2-NDPA: 0.04% of the weight of powder
tetramethylurea: 15% of the weight of powder Fragmentable blocks were thus obtained, exhibiting the following characteristics:

Appearance: correct
Potential energy: 3,680 joules/g that is 880 cal/g
Crushing strength:
2+1° C.: 1.89 kN/cm$^2$
100+° C.: 1.04 kN/cm$^2$

EXAMPLE 13

A fragmentable charge according to the invention was manufactured from particulate propellent powder coated with a mixture of dinitropolystyrene (DNPS) and polyvinyl nitrate (PVN) in the presence of 2-nitrodiphenylamine (2-NDPA) as stabiliser and using butyrolactone as solvent.

A procedure as described in Example 7 was carried out with a coating solution whose overall composition was as follows:

DNPS: 1% of the weight of powder
PVN: 1% of the weight of powder
2-NDPA: 0.04% of the weight of powder
butyrolactone: 15% of the weight of powder Fragmentable blocks were thus obtained, exhibiting the following characteristics:

Appearance: correct
Potential energy: 3,106 joules/g that is 743 cal/g
Crushing strength:
21+° C.: 0.85 kN/cm$^2$
+100° C.: 0.29 kN/cm$^2$

EXAMPLE 14

A fragmentable charge according to the invention was manufactured from particulate propellent powder coated with a mixture of dinitropolystyrene (DNPS) and polyvinyl nitrate (PVN) in the presence of 2-nitrodiphenylamine (2-NDPA) as stabiliser and using tetramethylene sulphone as solvent.

A procedure as described in Example 7 was carried out with a coating solution whose overall composition was as follows:

DNPS: 1% of the weight of powder
PVN: 1% of the weight of powder
acetone: 12% of the weight of powder
tetramethylene sulphone: 6% of the weight of powder
2-NDPA: 0.04% of the weight of powder Fragmentable blocks were thus obtained, exhibiting the following characteristics:

Appearance: correct
Potential energy: 3,712 joules/g that is 886 cal/g
Crushing strength:
+21° C.: 1.1 kN/cm$^2$
+100° C.: 0.6 kN/cm$^2$

EXAMPLE 15

A fragmentable charge according to the invention was manufactured by employing as propellent powder a composite powder whose composition was as follows:

hexogen (coated with 2% by weight of dioctylphthalate): 80 parts by weight
centralite: 0.4 parts by weight
nitrocellulose (nitrogen content 11.8%): 4 parts by weight
cellulose acetobutyrate: 9.6 parts by weight
TECA: 6 parts by weight The abbreviation TECA denotes triethyl citrate acetate of formula:

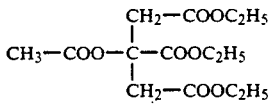

The potential energy of this powder was 3,595 joules/g, that is 860 cal/g. This powder was used in a procedure as described in Example 7 with a coating solution whose overall composition was as follows:

polyvinyl nitrate: 0.67% of the weight of powder
polyvinyl acetate: 0.67% of the weight of powder
dinitropolystyrene: 0.67% of the weight of powder
cyclohexanone: 10% of the weight of powder
acetone: 10% of the weight of powder Fragmentable blocks were thus obtained, exhibiting the following characteristics:

Appearance: correct
Potential energy: 3,574 joules/g that is 855 cal/g
Crushing strength:
+21° C.: 0 89 kN/cm$^2$
+100° C.: 0.59 kN/cm$^2$

We claim:

1. A fragmentable charge of compressed particulate propellant powder containing nitrocellulose, the particles of which were coated prior to compression with a film of a mixture of a dinitropolystyrene, a stabilizer and a polyvinyl alcohol derivative which is polyvinyl nitrate, polyvinyl acetate or mixture thereof or a mixture of said polyvinyl alcohol derivative and cellulose acetate.

2. The charge according to claim 1 wherein the weight ratio of dinitropolystyrene and said polyvinyl alcohol derivative is between 25% and 75%.

3. The charge according to claim 1 wherein the propellant powder is a nitrocellulose single base powder, a composite powder, a double base or a multibase powder.

4. The charge according to claim 1 wherein in said mixture of cellulose acetate and said polyvinyl alcohol derivative the amount of said polyvinyl alcohol derivative is at least one third by weight of the total weight of said polyvinyl alcohol derivative and said cellulose acetate.

5. The charge according to claim 1 wherein said dinitropolystyrene has a nitrogen content of 14.81%.

6. A propellant powder containing nitrocellulose having particles coated with a film of a mixture containing a dinitropolystyrene, a stabilizer and a polyvinyl alcohol derivative which is a member selected from the group consisting of polyvinyl nitrate, a polyvinyl acetate and mixtures thereof.

7. The powder according to claim 6 which is a nitrocellulose single base powder.

* * * * *